United States Patent [19]

Emi et al.

[11] 4,153,454

[45] May 8, 1979

[54] STEEL MATERIALS HAVING AN EXCELLENT HYDROGEN INDUCED CRACKING RESISTANCE

[75] Inventors: Toshihiko Emi; Osamu Haida, both of Chiba; Shinobu Okano; Shuji Watanabe, both of Kurashiki; Akitoshi Fujiwara, Togane; Toshiaki Shiraishi, Chiba; Hiroshi Ooi, Kurashiki; Toshio Iwasaki, Kurashiki; Noboru Okamoto, Kurashiki, all of Japan

[73] Assignee: Kawasaki Steel Corporation, Kobe, Japan

[21] Appl. No.: 863,601

[22] Filed: Dec. 23, 1977

[30] Foreign Application Priority Data

Aug. 12, 1977 [JP] Japan ..... 52-95992

[51] Int. Cl.[2] ..... C22C 38/06

[52] U.S. Cl. ..... 75/124; 75/123 R; 75/123 E; 75/125; 75/126 G; 75/128 E

[58] Field of Search ..... 75/124, 125, 123 R, 75/123 E, 126 G, 128 E; 148/36

[56] References Cited

U.S. PATENT DOCUMENTS

| | | | |
|---|---|---|---|
| 3,630,723 | 12/1971 | Asada | 75/123 R |
| 3,634,074 | 11/1972 | Ito et al. | 75/126 G |
| 3,652,267 | 3/1972 | Ito et al. | 75/123 R |
| 3,861,906 | 1/1975 | Tipnis et al. | 75/124 |
| 4,042,381 | 8/1977 | Thomas et al. | 75/123 E |
| 4,043,807 | 8/1977 | Kirman | 75/124 |
| 4,091,147 | 5/1978 | Kanazawa et al. | 75/123 E |

FOREIGN PATENT DOCUMENTS

| | | |
|---|---|---|
| 50-99911 | 8/1975 | Japan. |
| 51-114318 | 8/1976 | Japan. |

*Primary Examiner*—Arthur J. Steiner

[57] ABSTRACT

Steel materials having an excellent hydrogen induced cracking resistance when used under atmosphere containing $H_2S$, which contain 0.05 to 0.20% of C, 0.01 to 0.50% of Si, 0.60 to 2.00% of Mn, 0.01 to 0.10% of Al, less than 0.0020% of S, Ca of 0.0020% to less than 0.0050%. These steel materials are increased in the tensile strength by additionally containing at least one of Cu, Ni, Cr, B, Mo, Nb, V, Zr and Ti. Furthermore the effect of addition of Ca is stabilized by adding rare-earth elements.

7 Claims, 7 Drawing Figures

STEEL MATERIALS HAVING AN EXCELLENT HYDROGEN INDUCED CRACKING RESISTANCE

The present invention relates to the composition of steel materials having an excellent hydrogen induced cracking resistance and particularly to steel materials having a high resistance against hydrogen induced cracking which is generated under atmosphere containing hydrogen sulfide and water.

The leakage accident and the explosion accident due to the hydrogen induced cracking frequently occur at line pipes used for transporting crude oil and natural gas containing wet hydrogen sulfide.

This hydrogen induced cracking is a different phenomenon from the heretofore known sulfide stress corrosion crack of the high tension steel and occurs even under the condition where the stress is not substantially loaded. Also, the hydrogen induced cracking is characterized in that it occurs without almost being influenced with the tensile strength and the hardness of steel material.

From the study hitherto made, it has been found that the hydrogen induced cracks are caused by the pressure of hydrogen gas collected at the boundary between non-metallic inclusions and matrix as a result of diffusion to be followed by combination at the boundary of hydrogen atoms which are penetrated into the steel from the ambient atmosphere owing to corrosion. Among the non-metallic inclusions, elongated sulfide inclusions, such as MnS which have extensive incoherent boundary area and readily cause the stress concentration at the periphery of the inclusions due to the notch effect, are most harmful against the hydrogen induced cracking. Accordingly, as the amount of the elongated MnS increases, the crack sensitivity increases. It is recognized that the crack sensitivity tends to decrease with decreasing concentration of sulfur in the steel, but even if the concentration of sulfur in the steel is reduced to the degree which can be attained in the desulfurization step in an industrial scale, it has not been possible to practically avoid the occurrence of the cracks at the steel portion corresponding to A and V segregates in the steel ingot.

It has been heretofore known as the means for preventing the hydrogen induced cracking to add copper to the steel or to heat a slab of the steel prior to hot rolling at a high temperature for a long time.

In the former process, copper restrains the corrosion of the steel, so that the amount of hydrogen penetrating into the steel is reduced and hence the cracks become fewer but the cracks are practically formed along MnS and it has been impossible to completely prevent the formation of the cracks.

In the latter process, the elongated MnS at the position corresponding to A and V segregates is made spheroidic and hence the incoherent boundary area and notch effect are made smaller, and also the concentrated segregation of P, Mn and the like is reduced. These phenomena contribute to decrease the crack sensitivity, but the heating treatment at a high temperature for a long time is not practical in view of the cost.

Another known process for preventing the hydrogen induced cracking comprises adding 0.0001 to 0.005% of Ca within the range of S of 0.002 to 0.010%.

In this process, some fraction of sulfur in steel precipitates not as MnS but as CaS which is not elongated by the hot rolling, so that the hydrogen induced cracking resistance is improved. With this concentration range of Ca and S, however, it is impossible to make steel completely free of MnS. In particular, a large amount of MnS remains at the steel portion corresponding to A and V segregates in the steel ingot. Therefore, even if the other process, for example, the process for containing Cu is together used, the satisfactory hydrogen induced cracking resistance cannot be obtained.

On the other hand, if the concentration of S is as low as less than 0.010% and the concentration of Ca exceeds 0.005%, the hydrogen induced cracking resistance is more improved than the case with Ca of 0.0001 to 0.005%.

However, when the amount of Ca as large as more than 0.005% is added, numerous Ca-containing large non-metallic inclusions are formed by reoxidation, resulting in the defects in the welded portion and subsurface of the product, and further the cost of Ca addition becomes higher.

The conventional method to determine the hydrogen induced crack sensitivity has been as follows: A test sample was immersed for a given time in an artificial brine saturated with $H_2S$, and then the test sample was cut in several pieces to examine the cross-section with an optical microscope for the cracks. The disadvantage of this method, however, is that small cracks or thin cracks are possibly overlooked.

An object of the present invention is to provide the steel materials having an excellent hydrogen induced cracking resistance, which have advantageously obviated the above described defects.

The first and second aspects of the present invention are based on the novel discovery that the excellent hydrogen induced cracking resistance can be obtained by making the concentration of sulfur as low as less than 0.002% and permitting an appropriate amount of calcium to be contained.

The third aspect of the present invention is based on the discovery that the effect of calcium can be stabilized by reducing the concentration of sulfur to less than 0.002% and concurrently containing 0.002 to less than 0.005% of calcium and 0.008 to 0.030% of rare-earth elements.

The reason of the limitation of the concentrations of calcium and sulfur in the first and second aspects of the present invention will be explained based on the results obtained by the research of the commercial production scale.

Calcium was added by supplying iron-clad calcium wire to the molten steel at a pouring trumpet in the case of the bottom pouring of the normal ingot or at a tundish positioning between the ladle and the water cooling mold in the case of the continuous casting. Prior to addition of calcium, deoxidizing agents were added to the molten steel and then the molten steel was thoroughly stirred by the degassing treatment under vacuum in order to remove the deoxidized products to reduce the concentration of oxygen in the steel to not more than 35 ppm. The chemical composition of the test sample was as follows.

C: 0.06 to 0.17%, Si: 0.20 to 0.29%, Mn: 1.05 to 1.90%, P: 0.009 to 0.020%, S: 0.001 to 0.007% and Al: 0.028 to 0.045%.

This test steel sample contained appropriate amounts of Nb, Mo, V and the like and the influence of the addition of calcium on the hydrogen induced cracking resistance was determined with respect to this test sample.

The thus obtained steel ingot or continuously cast slab was hot rolled to obtain steel plates or strip. As shown in FIG. 1, both the upper surface and the lower surface of the rolled plates or strip were machined and removed in a thickness of 1 mm and such a plate or strip was cut in a size of 20 mm in the widthwise direction and 100 mm in the rolling direction to take a test piece. This test piece was immersed in an artificial brine (Composition ASTM D1141-52, Stock Solution No. 1+2, Temperature 25±3° C.) saturated with $H_2S$ under no stress load for 96 hours, and then taken out from the artificial brine. By using an immersion inspection technique with ultrasonic recording scanner, the whole surface parallel to the rolled surface was scanned and the cracks projected on the plane parallel to the rolled surface were automatically drawn (C-scan) and a ratio of the cracked area to the scanned area (referred to as the areal ratio of cracks as observed by C-scanning) was measured. One embodiment of the measured results is shown in FIG. 2. After this measurement, the test sample was divided into five equal parts vertically to the rolling direction and the four cross-sections appeared were observed with a microscope to determine cracks. In this case, the crack intensity was evaluated by so-called "crack sensitivity ratio". This crack sensitivity ratio is defined by the following expression to be the ratio of the sum of the area of all stepwise cracks to the cross-sectional area, A, of test sample examined:

$$\text{Crack sensitivity ratio} = \frac{\sum_i l_i d_i}{A} \times 100$$

where $l_i$ and $d_i$ are, as shown in FIG. 3, the length and width, respectively, of i-th stepwise crack (b, c and d) which is considered to be much more harmful than isolated crack, a.

In this measurement, only when the distance between thicknesswise neighbouring cracks in the above described cross-section lies in the scope of a circle of radius R (b, c and d in the case of FIG. 3), such a case is referred to as one stepwise crack, so that as R becomes larger, the crack sensitivity ratio is measured to be larger.

The inventors have made the measurement by setting R to a fairly large value of 0.5 mm in order to make particularly stringent evaluation.

Among the above described two measuring methods, the immersed inspection of the cracks with ultrasonic recording scanner detects through-thickness projection of all cracks (stepwise crack, isolated crack) in the test sample, so that this method is higher in the sensitivity than the microscopic inspection for the crack sensitivity ratio.

FIGS. 4*a* and 4*b* are views showing, respectively, the relations of the concentration of calcium to the crack sensitivity ratio and the areal ratio of cracks as observed by C-scanning of the steels of the first and second aspects of the present invention.

When the concentration of sulfur is 0.001% to less than 0.002% following to the present invention, if the concentration of calcium is not less than 0.0020%, the crack sensitivity ratio becomes zero (see FIG. 4*a*). Furthermore, in the more preferable range ($S<0.002\%$, $0.0040 \leqq Ca < 0.0050\%$) in the present invention, it can be seen that the areal ratio of cracks as observed by C-scanning also becomes factually zero (see FIG. 4*b*).

On the other hand, in the case of the comparative steels wherein the concentration of sulfur is 0.002% to 0.010%, the concentration of calcium must be not less than 0.005% in order to make the crack sensitivity ratio substantially zero (see FIG. 5*a*) but in this case the amount of Ca-containing large subsurface inclusions noticeably increases and such a steel is not practically useful. Furthermore, in the case of the comparative steels, even if calcium is added up to the highest concentration, which can be presently added, the areal ratio of cracks as observed by C-scanning does not become zero (see FIG. 5*b*).

That is, the steel materials, in which cracks are not detected at all even by the detailed measurement by using the ultrasonic recording scanner, have been firstly produced by the present invention.

The above described facts are the essential features of the first and second aspects of the present invention and the upper limit of the concentration of sulfur and the lower limit of the concentration of calcium have been defined based on the above described reasons. Furthermore, when the concentration of calcium becomes 0.0050% or more, the amount of Ca-containing large subsurface inclusions is suddenly increased, so that the concentration of calcium is limited to less than 0.0050%.

The object of the third aspect of the present invention is to broaden the essential range of the concentration of calcium in the first and second aspects of the present invention by permitting an appropriate amount of rare-earth elements to be contained. As seen from FIG. 4*b*, it is possible to make the areal ratio of cracks as observed by C-scanning zero without causing appreciable increase in the amount of Ca-containing large subsurface inclusions by lowering the concentration of sulfur to less than 0.0020% and containing 0.0040% to less than 0.0050% of calcium in the first and second aspects of the present invention.

The inventors have found that the preferable range of the concentration of calcium can be broadened to 0.0025 to less than 0.0050% by containing rare-earth elements in the total concentration of not less than 0.008%. When the concentration of rare-earth elements is less than 0.008%, a major part of rare-earth elements becomes oxides and such an addition has no function to prevent the precipitation of MnS, so that said concentration has no effect to broaden the preferable range. When the concentration of rare-earth elements exceeds 0.030%, even if the calcium content is less than 0.0050%, considerable amount of large subsurface inclusions containing rare-earth elements are formed.

Accordingly, in the first and second aspects of the invention, when 0.008 to 0.030% of rare-earth elements is contained, it is possible to make the areal ratio of cracks as observed by C-scanning zero without forming the large subsurface inclusions in a broad range of Ca concentration of 0.0025% to less than 0.0050%.

In the first, second and third aspects of the invention, the concentrations of the components other than Ca, REM (rare-earth elements) and S are limited by the following reasons.

C: When the content is less than 0.05%, the necessary tensile strength cannot be obtained, while when said content exceeds 0.20%, the toughness and the weldability of the steel are not preferable, so that the content is defined to be 0.05 to 0.20%.

Si: This component is an element necessary for deoxidation but an amount of less than 0.01% has virtually no deoxidizing activity and when exceeding 0.50%, there is fear that the toughness is deteriorated, so that the content is defined to be 0.01 to 0.50%.

Mn: When the content is less than 0.60%, the desirable tensile strength cannot be obtained, while when exceeding 2.00%, the toughness and the weldability become poor, so that the content is defined to be 0.60 to 2.00%.

Al: This component is necessary for deoxidation but when the content is less than 0.01%, the desirable deoxidizing activity is not obtained, while when exceeding 0.10%, the grain size becomes coarse and the quality is deteriorated, so that the content is defined to be 0.01 to 0.10%.

At least one of the alloy elements described hereinafter may be contained and in this case, the effect of the present invention also can be attained:

Cu: When the content is not less than 0.20%, this component gives the corrosion resistance to the steel but when exceeding 0.60%, the hot workability is deteriorated.

Ni: This component is harmful against the crack due to $H_2S$ and the small amount is desirable but when 0.20 to 0.60% of Cu is contained, it is desirable to add 0.10 to 0.60% of Ni in order to prevent the hot shortness due to Cu.

Cr: This component is effective for the tensile strength and the corrosion resistance but the content is defined to be not more than 0.80% in order to prevent the deterioration of the toughness.

B: This component is added in order to improve the hardenability and when the content is less than 0.0005%, there is no effect and when exceeding 0.005%, the toughness is deteriorated.

Mo, Nb, V and Zr are contained in order to obtain the necessary tensile strength but any of the upper limits is defined in view of the deterioration of the toughness and the economical reason as the product.

Ti is contained in order to make the effect of addition of B effective but when the content is less than 0.01%, there is no effect and when exceeding 0.10%, the toughness is deteriorated.

These additive components are used in the appropriate amounts in order to satisfy the requirement of the mechanical properties of the steels.

Less than 0.03% of P is acceptable as the tolerable impurity in the steel composition of the present invention and the content of not less than 0.03% is not preferable in view of the toughness and the weldability and phosphorus is liable to be segregated at the segregation layer and the hydrogen induced crack sensitivity of the steel is increased. The other impurities are usually within the range which inevitably remains in the production of the steel.

The present invention will be explained in more detail.

For a better understanding of the invention, reference is taken to the accompanying drawings, wherein.

Figure 1:
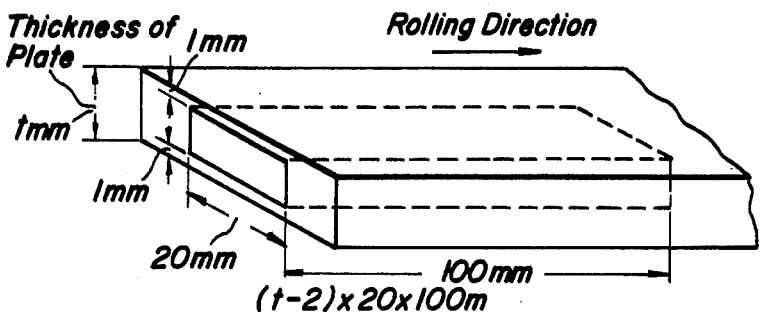
FIG. 1 is a view for explaining the process for making a test sample for the hydrogen induced cracking.
Figure 2:
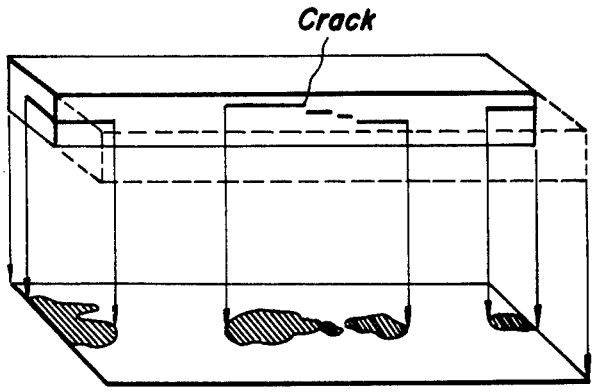
FIG. 2 is a view for explaining the measuring process of the hydrogen induced cracking by using an ultrasonic recording scanner.
Figure 3:
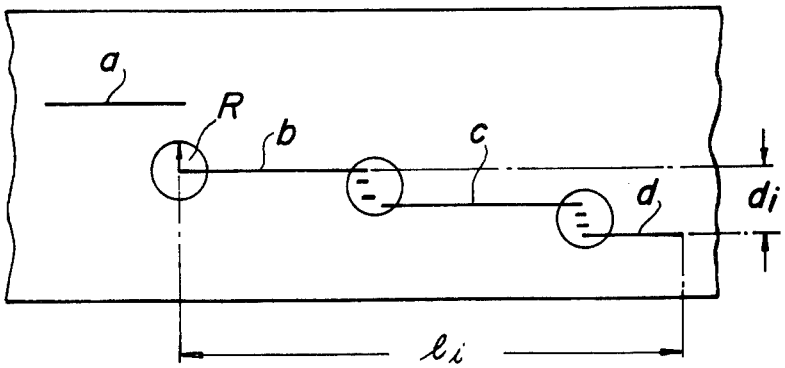
FIG. 3 is a view for explaining the process for measuring the crack sensitivity ratio.
Figure 4A:
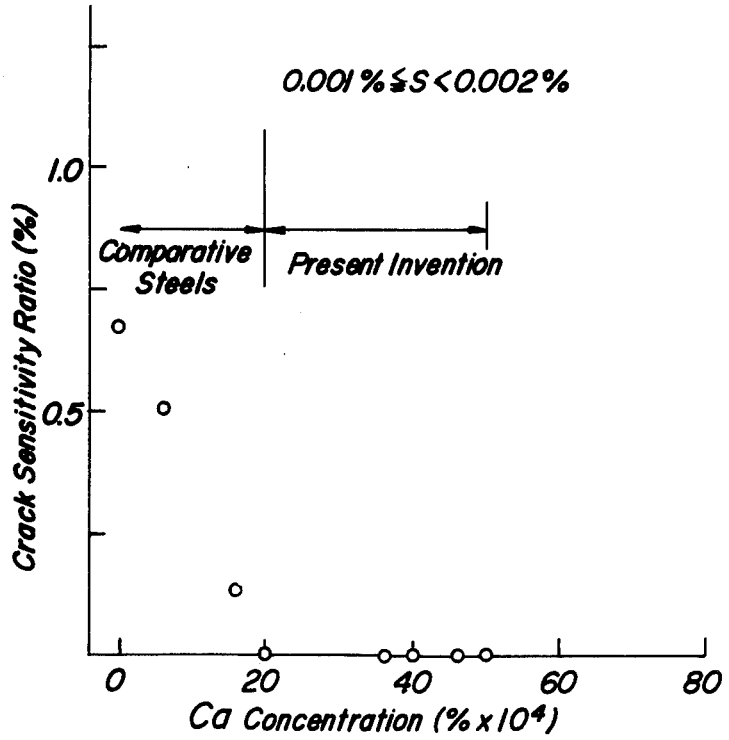
Figure 4B:
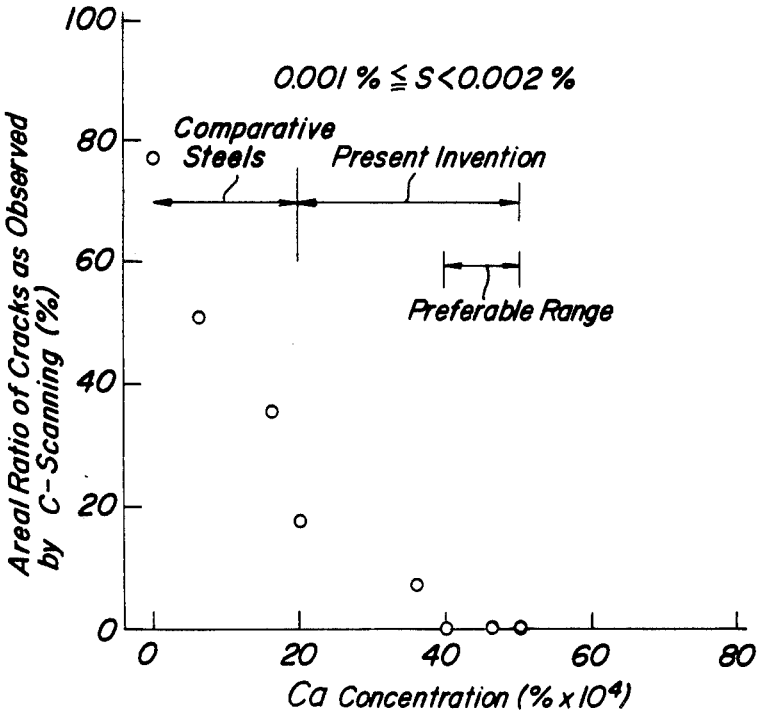
Figure 5A:
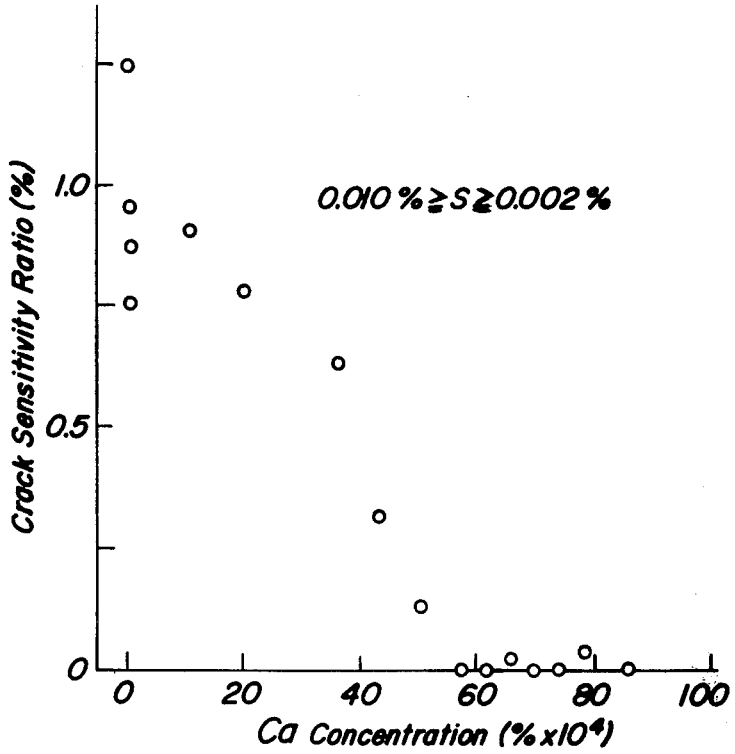
Figure 5B:
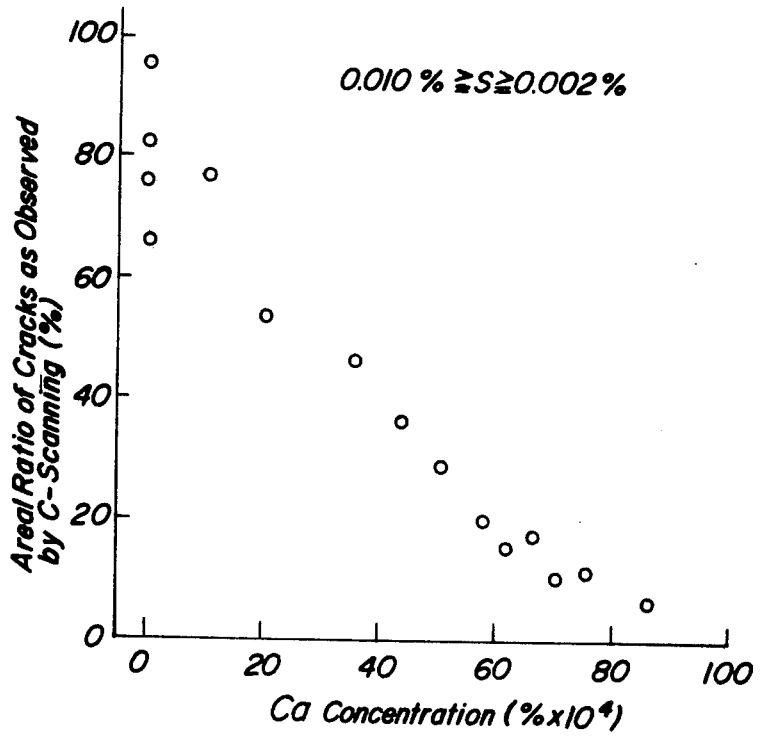

FIGS. 4*a* and 4*b* are the graphs showing the relations of Ca concentration to the crack sensitivity ratio and the areal ratio of cracks as observed by C-scanning of the steels of the present invention and the comparative steels respectively; and FIGS. 5*a* and 5*b* are the graphs showing the relations of Ca concentration to the crack sensitivity ratio and the areal ratio of cracks as observed by C-scanning of the comparative steels, respectively.

The following examples are given for the purpose of illustration of this invention and are not intended as limitations thereof.

EXAMPLE 1

When tapping molten steel, manganese, silicon and aluminum were added thereto and then the molten steel was subjected to RH treatment for 25 minutes to sufficiently lower the oxygen concentration and when the thus treated molten steel was cast into 23 ton cast ingot by the bottom pouring, iron-clad calcium wire was supplied between the ladle and the pouring trumpet to add Ca. With respect to this example, the test results of the steels of the present invention and the comparative steels are shown in Table 1.

Table 1

| | Chemical components (Wt. %) | | | | | | | | Large subsurface inclusion | Crack sensitivity ratio | Areal ratio of cracks as observed by C-scanning |
|---|---|---|---|---|---|---|---|---|---|---|---|
| | C | Si | Mn | P | S | Al | Ca | Other components | (number/m²) | (%) | (%) |
| Present invention | | | | | | | | | | | |
| 1 | 0.10 | 0.27 | 1.26 | 0.019 | 0.0019 | 0.038 | 0.0040 | | 0 | 0 | 0 |
| | | | | | | | | Mo-0.28, B-0.0005 | 0 | 0 | 0 |
| 2 | 0.09 | 0.25 | 1.53 | 0.013 | 0.0014 | 0.056 | 0.0048 | Nb-0.043, Ti-0.035 | 0 | 0 | 0 |
| 3 | 0.15 | 0.24 | 1.37 | 0.020 | 0.0018 | 0.041 | 0.0046 | | 0 | 0 | 0 |
| 4 | 0.14 | 0.27 | 1.33 | 0.017 | 0.0018 | 0.041 | 0.0036 | Cr-0.38 | 0 | 0 | 7 |
| 5 | 0.13 | 0.26 | 1.25 | 0.017 | 0.0015 | 0.045 | 0.0020 | Cu-0.21, Ni-0.20 Ti-0.03 | 0 | 0 | 17 |
| 6 | 0.09 | 0.28 | 1.48 | 0.015 | 0.0018 | 0.027 | 0.0030 | V-0.040, Nb-0.027 | 0 | 0 | 15 |
| Comparative steels | | | | | | | | | | | |
| 1 | 0.16 | 0.40 | 1.41 | 0.023 | 0.003 | 0.055 | 0.0036 | | 0 | 0.63 | 46 |
| 2 | 0.15 | 0.38 | 1.44 | 0.024 | 0.004 | 0.041 | 0.0050 | | 0 | 0.13 | 29 |
| 3 | 0.16 | 0.41 | 1.07 | 0.018 | 0.003 | 0.034 | 0.0086 | | 9.2 | 0 | 6 |
| 4 | 0.17 | 0.39 | 1.31 | 0.016 | 0.005 | 0.036 | 0.0066 | | 10.1 | 0.02 | 17 |
| 5 | 0.10 | 0.26 | 1.08 | 0.009 | 0.003 | 0.038 | 0.0020 | NB-0.039 | 0 | 0.76 | 53 |
| 6 | 0.11 | 0.26 | 1.12 | 0.017 | 0.003 | 0.042 | 0.0074 | NB-0.044 | 4.0 | 0 | 11 |
| 7 | 0.15 | 0.14 | 1.55 | 0.016 | 0.0018 | 0.031 | 0.0016 | NB-0.027, V-0.035 | 0 | 0.13 | 35 |
| 8 | 0.12 | 0.25 | 1.15 | 0.015 | 0.0018 | 0.046 | 0.0005 | | 0 | 0.50 | 50 |

more preferable range

Table 1-continued

| | Chemical components (Wt. %) | | | | | | | | Large subsurface inclusion | Crack sensitivity ratio | Areal ratio of cracks as observed by C-scanning |
|---|---|---|---|---|---|---|---|---|---|---|---|
| | C | Si | Mn | P | S | Al | Ca | Other components | (number/m$^2$) | (%) | (%) |
| 9 | 0.10 | 0.27 | 1.60 | 0.013 | 0.0023 | 0.038 | 0.0025 | | 0 | 0.11 | 25 |

The number of the large subsurface inclusions in the table was determined as follows: The steel ingot was hot rolled into a thickness of about 1/6 to form a slab. One side surface was machined to the depth of 2 mm, 4 mm, 6 mm and 8 mm from the surface and with respect to each depth of the machined surface, the number of the inclusions extending more than 5 mm in the rolling direction was counted on S-print and the average number of the inclusions in 2 to 8 mm depth from the surface was calculated.

As seen from Table 1, in the steels of the first and second aspects of the present invention, the crack sensitivity ratio is zero and there is no large subsurface inclusions. In the preferable range of the present invention, the areal ratio of cracks as observed by C-scanning is also zero. On the other hand, in many comparative steels, the crack sensitivity ratio is not zero and even if the crack sensitivity ratio is zero, the large subsurface inclusions appear and the areal ratio of cracks as observed by C-scanning does not become zero.

EXAMPLE 2

When tapping molten steel, manganese, silicon and aluminum were added thereto and then the molten steel was subjected to RH treatment for 25 minutes to sufficiently lower the oxygen concentration. To the thus treated molten steel in the ladle was added mischmetal. When casting the molten steel by the bottom pouring, Ca was added in the same manner as described in Example 1. With respect to this example, the test results of the steels of the present invention and the comparative steels are shown in Table 2. The test method was the same as in Example 1.

subsurface inclusions are formed and this steel is not preferable.

The steel materials of the present invention may be produced by using any of the steel ingot and the continuously cast slab. These steels are characterized in that they have the tensile strength and the toughness necessary for the line pipe and that the occurrence of the stepwise hydrogen induced cracks and the isolated hydrogen induced cracks is completely prevented.

Furthermore, the addition of calcium or rare-earth elements to the concentration ranges specified above obviates the defects of the conventional process wherein the amount of large subsurface inclusions are increased and the surface effects and the ultrasonically inspected defects are increased, and the important characteristics of the present invention consist in the fact that these excellent hydrogen induced cracking resistance can be obtained.

The insusceptibility to the hydrogen induced cracking of the steels of the present invention can be developed in the hot rolled steel and any steels treated with hardening, tempering and annealing, and the insusceptibility to the hydrogen induced cracking is not influenced by the treatments and the conditions.

The present invention can be applied to steel materials to be used under atmosphere containing $H_2S$, for example, oil pipes and LPG tank materials as well as steels for line pipes.

As the process for adding Ca, Ca or Ca alloy powders or mixtures of Ca and it compounds may be blown into the molten steel together with a transporting gas other than iron-clad calcium wire and in this case, if the composition of the steel materials is within the range of the Table 2

| | Chemical components (Wt. %) | | | | | | | | | Large subsurface inclusion | Crack sensitivity ratio | Areal ratio of cracks as observed by C-scanning |
|---|---|---|---|---|---|---|---|---|---|---|---|---|
| | C | Si | Mn | P | S | Al | Ca | REM* | Other components | (number/m$^2$) | (%) | (%) |
| Present invention | | | | | | | | | | | | |
| 1 | 0.11 | 0.36 | 1.38 | 0.014 | 0.0015 | 0.031 | 0.0025 | 0.023 | | 0 | 0 | 0 |
| 2 | 0.15 | 0.28 | 1.49 | 0.015 | 0.0018 | 0.026 | 0.0032 | 0.008 | NB-0.016, V-0.026, Mo-0.14, Ti-0.011 | 0 | 0 | 0 |
| 3 | 0.09 | 0.40 | 1.56 | 0.013 | 0.0014 | 0.041 | 0.0030 | 0.015 | Nb-0.040 | 0 | 0 | 0 |
| Comparative steels | | | | | | | | | | | | |
| 1 | 0.16 | 0.39 | 1.28 | 0.016 | 0.0030 | 0.027 | 0.0046 | 0.023 | | 0 | 0.03 | 8 |
| 2 | 0.12 | 0.27 | 1.15 | 0.018 | 0.0018 | 0.034 | 0.0036 | 0.032 | | 2.1 | 0 | 0 |
| 3 | 0.10 | 0.25 | 1.55 | 0.013 | 0.0040 | 0.041 | 0.0045 | 0.038 | Nb-0.036 | 6.8 | 0.04 | 11 |

(*Rare-earth elements)

In Table 2, steel Nos. 1, 2, 3 of the third aspect of the present invention do not cause the hydrogen induced cracking and there is no large subsurface inclusions.

On the contrary, in comparative steels 1 and 3 wherein the concentration of sulfur is as high as 0.0030% and 0.0040%, the hydrogen induced cracks detected by the ultrasonic recording scanner were caused. In comparative steel 2 wherein the concentration of rare-earth elements exceeds 0.0030%, the large present invention, the insusceptibility to the hydrogen induced cracking can be obtained.

What is claimed is:

1. In a steel having excellent hydrogen induced cracking resistance, which consists essentially of 0.05 to 0.20% of C, 0.01 to 0.50% of Si, 0.60 to 2.00% of Mn and 0.01 to 0.10% of Al and which is used under atmosphere containing hydrogen sulfide, the improvement wherein said steel contains S in an amount less than 0.0020% and Ca in an amount of 0.0020% to less than 0.0050%, the remainder being Fe inclusive inevitable impurities.

2. In a steel having excellent hydrogen induced cracking resistance and a high tensile strength, which consists essentially of 0.05 to 0.20% of C, 0.01 to 0.50% of Si, 0.60 to 2.00% of Mn and 0.01 to 0.10% of Al and which is used under atmosphere containing hydrogen sulfide, the improvement wherein said steel contains S in an amount less than 0.0020% and Ca in an amount of 0.0020% to less than 0.0050%, and further containing at least one of 0.20 to 0.60% of Cu, 0.10 to 0.60% of Ni, less than 0.80% of Cr, 0.0005 to 0.0050% of B, 0.10 to 0.80% of Mo, 0.01 to 0.15% of Nb, 0.01 to 0.15% of V, 0.01 to 0.10% of Zr, and 0.01 to 0.10% of Ti, the remainder being Fe inclusive inevitable impurities.

3. The steel as claimed in claim 1, wherein said steel additionally contain at least one of rare-earth elements in the total amount of 0.008 to 0.030%.

4. The steel as claimed in claim 2, wherein said steel additionally contain at least one of rare-earth elements in the total amount of 0.008 to 0.030%.

5. The steel as claimed in claim 1, wherein the content of Ca is 0.0040% to less than 0.0050%.

6. The steel as claimed in claim 2, wherein the content of Ca is 0.0040% to less than 0.0050%.

7. The steel as claimed in claim 3, wherein the content of Ca is 0.0025% to less than 0.0050%.

* * * * *